US008910312B1

(12) United States Patent
Apisa

(10) Patent No.: US 8,910,312 B1
(45) Date of Patent: Dec. 16, 2014

(54) SNEEZE CATCHING METHOD AND APPARATUS

(76) Inventor: Joseph S. Apisa, Colts Neck, NJ (US)

( * ) Notice: Subject to any disclaimer, the term of this patent is extended or adjusted under 35 U.S.C. 154(b) by 537 days.

(21) Appl. No.: 13/360,908

(22) Filed: Jan. 30, 2012

(51) Int. Cl.
*A41D 27/12* (2006.01)

(52) U.S. Cl.
USPC ..... 2/59; 2/170

(58) Field of Classification Search
CPC ..... A41B 1/00; A41D 13/08; A41D 13/1245; A41D 27/10; A41D 2400/36
USPC ..... 2/16, 20, 160, 162, 59, 170, 243.1, 2/249–251; 224/219, 221, 222, 267, 660; 424/402–404
See application file for complete search history.

(56) References Cited

U.S. PATENT DOCUMENTS 4,244,057 A 1/1981 Burnham
4,536,889 A 8/1985 Tayor et al.
4,805,242 A * 2/1989 Bolton ..... 2/160
D446,381 S 8/2001 Garfield
7,690,050 B2 4/2010 Stockhamer
7,766,014 B2 8/2010 Piret
2002/0073475 A1* 6/2002 Bloom et al. ..... 2/69
2004/0031120 A1* 2/2004 Cherian ..... 15/227
2009/0145445 A1 6/2009 Quinn
2011/0314581 A1* 12/2011 Gaters ..... 2/16

* cited by examiner

*Primary Examiner* — Katherine Moran

(57) ABSTRACT

A sneeze catching apparatus includes a sleeve having a first open end, a second open end and a perimeter wall. A frame coupled to the perimeter wall and has an exterior edge and an interior edge. The frame has an attached edge and a free edge positioned opposite of each. The frame is positioned in an open position having the free edge spaced from the sleeve or in a closed position having the free edge secured to the sleeve. The frame bounds a receiving space. An air and fluid covering is attached to the interior edge. A closure is mounted on the sleeve and releasably retains the frame in the closed position. A pad is removably positioned in the receiving space. The pad has anti-bacterial properties. The sleeve worn on an arm of a person to capture and destroy bacteria exhaled by the person.

9 Claims, 3 Drawing Sheets

SNEEZE CATCHING METHOD AND APPARATUS

BACKGROUND OF THE DISCLOSURE

Field of the Disclosure

The disclosure relates to germ catching devices and more particularly pertains to a new germ catching device for capturing germs exhaled by a person during a sneeze or a cough.

SUMMARY OF THE DISCLOSURE

An embodiment of the disclosure meets the needs presented above by generally comprising a sleeve having a first open end, a second open end and a perimeter wall attached to and extending between the first and second open ends. A frame is pivotally coupled to the perimeter wall. The frame has an exterior edge, an interior edge, an upper surface and a lower surface. The frame has an attached edge and a free edge positioned opposite of each other wherein the attached edge is attached to the perimeter wall. The frame is positioned in an open position having the free edge spaced from the sleeve or in a closed position having the free edge secured to the sleeve. The frame bounds a receiving space when the frame is in the closed position. A covering is attached to and coextensive with the interior edge. The covering extends over the receiving space and is comprised of an air and fluid permeable material. A closure is mounted on the sleeve and releasably retains the frame in the closed position. A pad is removably positioned in the receiving space. The pad has anti-bacterial properties. The sleeve is configured to be worn on an arm of a person such that the person may sneeze or cough into the pad and the pad captures and destroys bacteria exhaled by the person.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF THE DRAWINGS

The disclosure will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
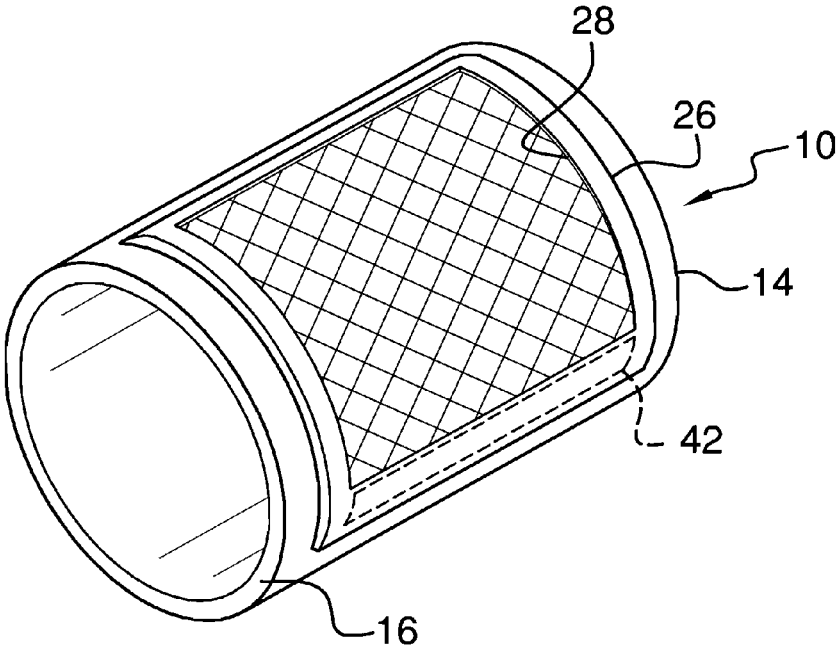
FIG. 1 is a front perspective view of a sneeze catching method and apparatus according to an embodiment of the disclosure.
Figure 2:
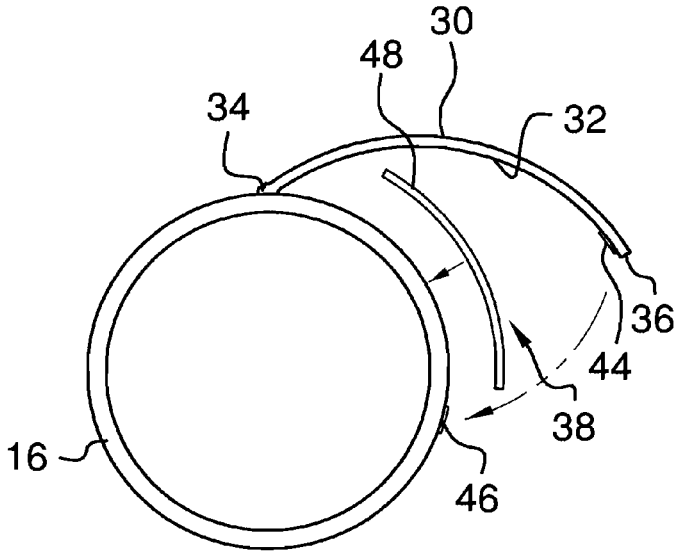
FIG. 2 is an end view of an embodiment of the disclosure.
Figure 3:
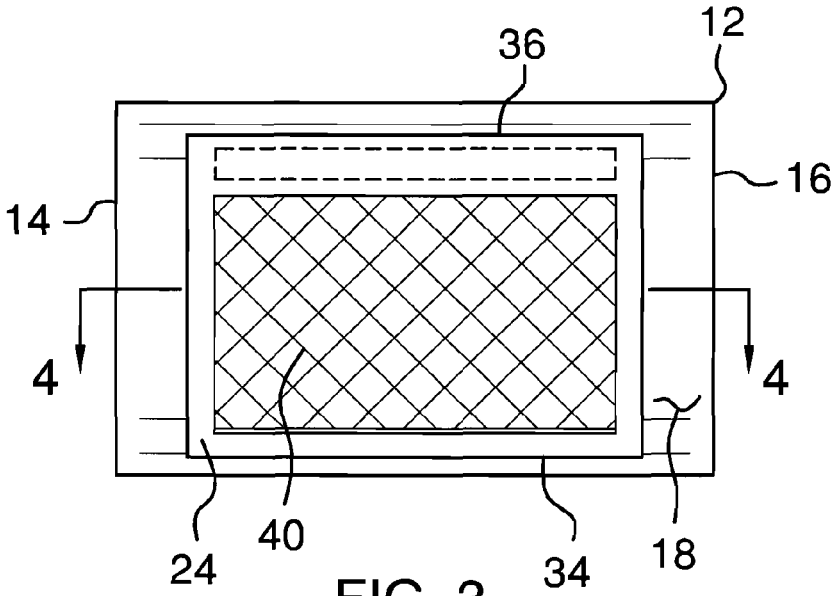
FIG. 3 is a front view of an embodiment of the disclosure.
Figure 4:
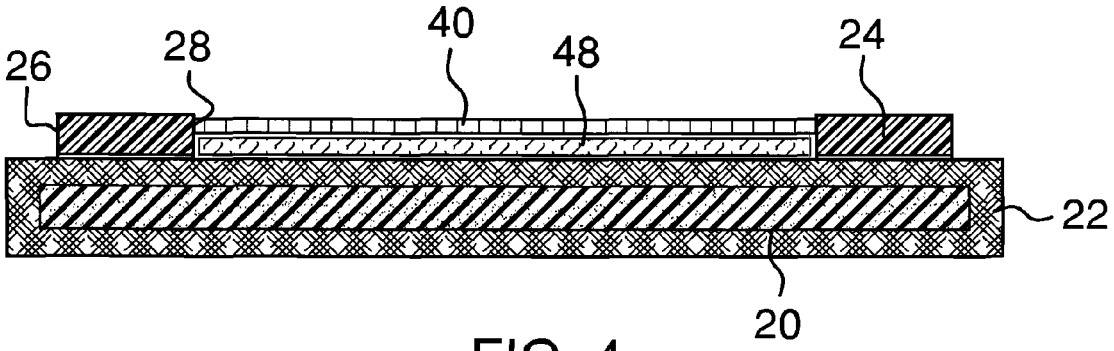
FIG. 4 is a cross-sectional view of an embodiment of the disclosure taken along line 4-4 of FIG. 3.

With reference now to the drawings, and in particular to FIGS. 1 through 5 thereof, a new germ catching device embodying the principles and concepts of an embodiment of the disclosure and generally designated by the reference numeral 10 will be described.

As best illustrated in FIGS. 1 through 5, the sneeze catching method and apparatus 10 generally comprises a sleeve 12 that has a first open end 14, a second open end 16 and a perimeter wall 18 attached to and extending between the first 12 and second 14 open ends. The sleeve 12 is resiliently stretchable and may include an interior layer 20 and an exterior layer 22 wherein the interior layer 20 comprises an elastomeric material and the exterior layer 22 comprises a cloth material. This allows the sleeve 12 to be washed as needed.

A frame 24 is pivotally coupled to the perimeter wall 18. The frame 24 has an exterior edge 26, an interior edge 28, an upper surface 30 and a lower surface 32. The frame 24 has an attached edge 34 and a free edge 36 positioned opposite of each other. The attached edge 34 is attached to the perimeter wall 18. The frame 24 is positioned in an open position having the free edge 36 spaced from the sleeve 12 or in a closed position with the free edge 36 secured to the sleeve 12. The frame 24 bounds a receiving space 38 when the frame 24 is in the closed position. The frame 24 generally extends between the first 14 and second 16 open ends and has a size such that the frame 24 extends less than one half of a circumference around the sleeve 12 when the frame 24 is in the closed position. The frame 24 is comprised of a flexible material such as a plastic or elastomeric material which allows the frame 24 to pivot relative to the sleeve 12 as stated above. The frame 24 may have a rectangular shape.

A covering 40 is attached to and is coextensive with the interior edge 28. The covering 40 extends over the receiving space 38 and is comprised of an air and fluid permeable material. The covering 40 may, in particular, comprise a mesh material formed of synthetic fibers.

A closure 42 is mounted on the sleeve 12 and releasably retains the frame 24 in the closed position. The closure 42 may comprise a hook and loop fastener including a first mating member 44 attached to the lower surface 32 adjacent to the free edge 36 and a second mating member 46 attached to the sleeve 12 and positioned to abut the first mating member 44 when the frame 24 is in the closed position. Alternative closures such as zippers, snaps or adhesives may be used.

A pad 48 is removably positioned in the receiving space 38. The pad 48 has anti-bacterial properties. Such pads 48 are conventional and may include any known anti-bacterial or anti-microbial type agent. These pads 48 are flexible and furthermore often comprised of a paper or paper-like material.

Figure 5:
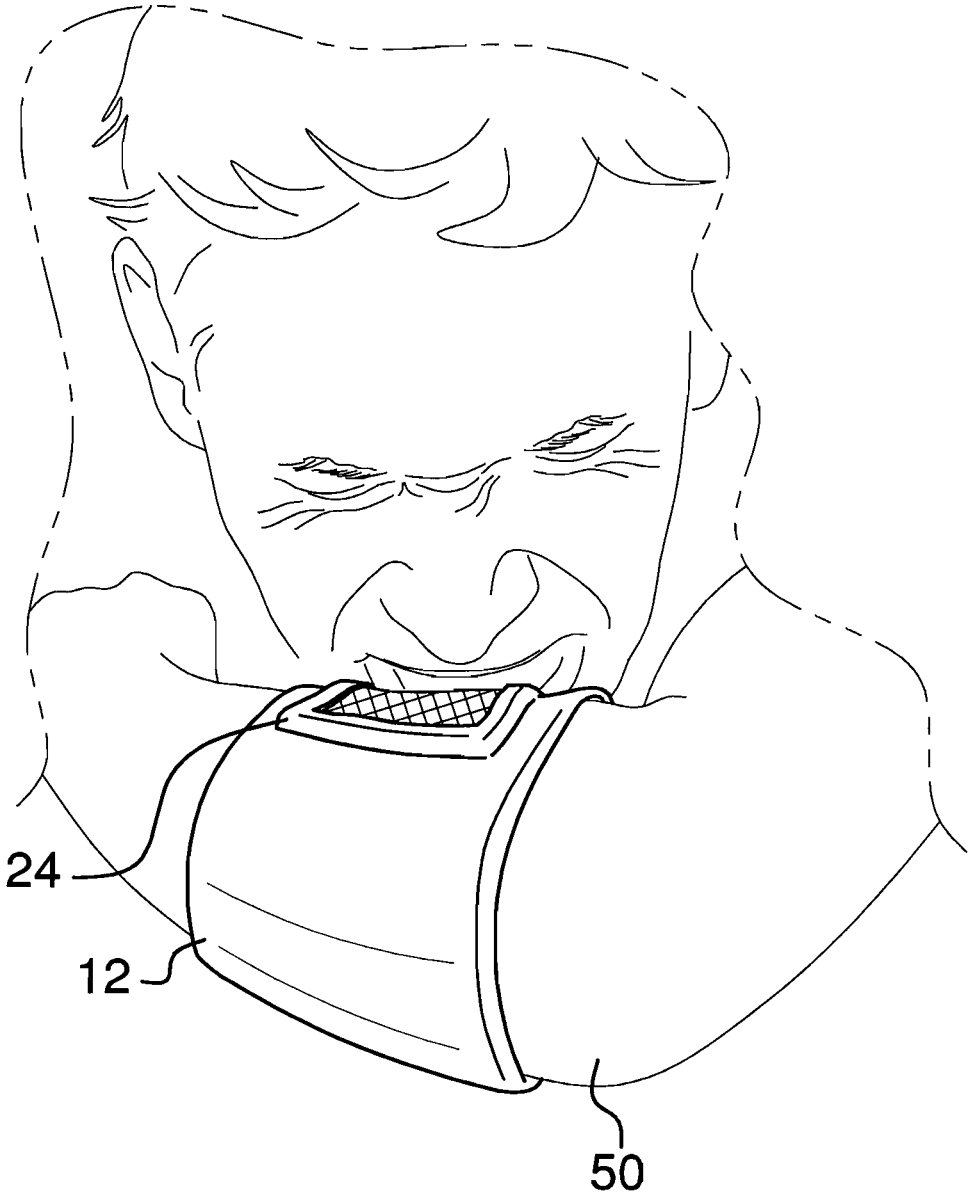
FIG. 5 is a perspective in-use view of an embodiment of the disclosure.

In use, the sleeve 12 is operatively attached to a person's arm 50 by frictional means which includes the ability of the sleeve to resistively stretch and thereby elastically engage the person's arm 50. When the person sneezes or coughs, they will place their face against the covering 40 as is shown in FIG. 5. The bacteria exhaled by the person will pass through the covering 40 and be captured by the pad 48 where its anti-bacterial agent will destroy any bacterial transferred to the pad 48. After usage, the pad 48 is removed and may be replaced by a new pad. Therefore, the apparatus 10 may include a kit further including a plurality of said pads 48.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure.

I claim:

1. An apparatus for catching bodily fluids ejected during a sneeze or cough, said apparatus comprising:

a sleeve having a first open end, a second open end and a perimeter wall being attached to and extending between said first and second open ends;

a frame being pivotally coupled to said perimeter wall, said frame having an exterior edge, an interior edge, an upper surface and a lower surface, said frame having an attached edge and a free edge positioned opposite of each other, said attached edge being attached to said perimeter wall, said frame being positioned in an open position having said free edge spaced from said sleeve or in a closed position having said free edge secured to said sleeve, said frame bounding a receiving space when said frame is in said closed position;

a covering being attached to and being coextensive with said interior edge, said covering extending over said receiving space, said covering being comprised of an air and fluid permeable material;

a closure being mounted on said sleeve and releasably retaining said frame in said closed position;

a pad being removably positioned in said receiving space, said pad having anti-bacterial properties; and wherein said sleeve is configured to be worn on an arm of a person such that the person may sneeze or cough into said pad and that said pad captures and destroys bacteria exhaled by the person.

2. The apparatus according to claim 1, wherein said sleeve is resiliently stretchable.

3. The apparatus according to claim 2, wherein said sleeve includes an interior layer and an exterior layer wherein said interior layer comprises an elastomeric material and said exterior layer comprises a cloth material.

4. The apparatus according to claim 1, wherein said frame extends less than one half of a circumference around said sleeve when said frame is in said closed position.

5. The apparatus according to claim 4, wherein said frame is comprised of a flexible material.

6. The apparatus according to claim 5, wherein said frame is rectangular shaped.

7. The apparatus according to claim 1, wherein said closure comprises a hook and loop fastener including a first mating member attached to said lower surface adjacent to said free edge and a second mating member attached to said sleeve and positioned to abut said first mating member when said frame is in said closed position.

8. An apparatus for catching bodily fluids ejected during a sneeze or cough, said apparatus comprising:

a sleeve having a first open end, a second open end and a perimeter wall being attached to and extending between said first and second open ends, said sleeve being resiliently stretchable, said sleeve including an interior layer and an exterior layer wherein said interior layer comprises an elastomeric material and said exterior layer comprises a cloth material;

a frame being pivotally coupled to said perimeter wall, said frame having an exterior edge, an interior edge, an upper surface and a lower surface, said frame having an attached edge and a free edge positioned opposite of each other, said attached edge being attached to said perimeter wall, said frame being positioned in an open position having said free edge spaced from said sleeve or in a closed position having said free edge secured to said sleeve, said frame bounding a receiving space when said frame is in said closed position, said frame extending less than one half of a circumference around said sleeve when said frame is in said closed position, said frame being comprised of a flexible material, said frame being rectangular shaped;

a covering being attached to and being coextensive with said interior edge, said covering extending over said receiving space, said covering being comprised of an air and fluid permeable material;

a closure being mounted on said sleeve and releasably retaining said frame in said closed position, said closure comprising a hook and loop fastener including a first mating member attached to said lower surface adjacent to said free edge and a second mating member attached to said sleeve and positioned to abut said first mating member when said frame is in said closed position;

a pad being removably positioned in said receiving space, said pad having anti-bacterial properties; and wherein said sleeve is configured to be worn on an arm of a person such that the person may sneeze or cough into said pad and that said pad captures and destroys bacteria exhaled by the person.

9. A method for catching bodily fluids ejected during a sneeze or cough, said method including the steps of:

operatively attaching a sleeve on a person's arm, said sleeve having a first open end, a second open end and a perimeter wall being attached to and extending between said first and second open ends, a frame being pivotally coupled to said perimeter wall, said frame having an exterior edge, an interior edge, an upper surface and a lower surface, said frame having an attached edge and a free edge positioned opposite of each other, said attached edge being attached to said perimeter wall, said frame being positioned in an open position having said free edge spaced from said sleeve or in a closed position having said free edge secured to said sleeve, said frame bounding a receiving space when said frame is in said closed position, a covering being attached to and being coextensive with said interior edge, said covering extending over said receiving space, said covering being comprised of an air and fluid permeable material, a closure being mounted on said sleeve and releasably retaining said frame in said closed position;

placing said frame in said open position;

positioning a pad in said receiving space, said pad having anti-bacterial properties;

placing said frame in said closed position;

receiving bodily fluids by the person during a sneeze or cough of the person; and replacing said pad.

* * * * *